US005704844A

United States Patent [19]

Luther

[11] Patent Number: 5,704,844

[45] Date of Patent: Jan. 6, 1998

[54] APPARATUS FOR DISPENSING AND TEEING GOLF BALLS

[76] Inventor: James K. Luther, 1120 Patt St., Box 5, Creston, Iowa 50801

[21] Appl. No.: 681,120

[22] Filed: Jul. 22, 1996

[51] Int. Cl.[6] ..... A63B 57/00

[52] U.S. Cl. ..... 473/137

[58] Field of Search ..... 473/132, 133, 473/134, 135, 136, 137

[56] References Cited

U.S. PATENT DOCUMENTS

| | | | |
|---|---|---|---|
| 1,868,261 | 7/1932 | Spencer | 473/134 |
| 1,940,321 | 12/1933 | Pagett . | |
| 2,013,881 | 9/1935 | Fleming . | |
| 2,212,877 | 8/1940 | Gale . | |
| 3,127,177 | 3/1964 | Benkoe . | |
| 3,599,983 | 8/1971 | Molton . | |
| 3,738,662 | 6/1973 | Hodgin | 473/133 |
| 4,265,453 | 5/1981 | Loof | 473/137 |
| 4,796,893 | 1/1989 | Choi . | |
| 4,817,955 | 4/1989 | Hickson et al. | 473/136 |
| 5,322,291 | 6/1994 | Smith et al. . | |
| 5,346,222 | 9/1994 | Luther, Sr. | 473/137 |
| 5,458,339 | 10/1995 | Wildes | 473/137 |
| 5,549,518 | 8/1996 | Wang | 473/137 |

*Primary Examiner*—Steven B. Wong
*Attorney, Agent, or Firm*—Zarley, McKee, Thomte, Voorhees & Sease

[57] ABSTRACT

The golf ball dispensing and teeing device of this invention has an elongated ball dispensing arm pivotally secured to a frame. The arm has a loading end and a dispensing end. A spring connects the arm to the frame while normally holding the loading end at a lower elevation than the dispensing end. A tubular member on the frame above the loading end is adapted to hold a plurality of golf balls comprised of a lower ball with a column of balls supported on the lower ball. The loading end of the arm has a dispensing block with a curved notch for holding the lower ball when the dispensing end is at a raised elevation, and for releasing the lower ball when the dispensing end is lower than the lower ball. The dispensing block is aligned with the arm so that when the arm is lowered the lower ball will roll down the arm from the loading end. A tee element on the frame below the dispensing end receives the lower ball when the arm is lowered. The tubular member has an upper end with a horizontal plate thereon with an opening to pass a single golf ball therethrough. A plurality of vertically disposed ball compartments are rotatably mounted on the plate with each having an open end adapted to register with the opening in the plate to selectively dispense balls through the opening when the compartments are rotated.

9 Claims, 6 Drawing Sheets

10
34
41
70
62
66
68
80
60
56
56A
56B
82
44
84
18
12
16

APPARATUS FOR DISPENSING AND TEEING GOLF BALLS

BACKGROUND OF THE INVENTION

Automatic golf ball teeing machines have existed for many years. Such machines are designed for use on practice ranges. However, they have not been universally accepted for a number of reasons. First of all, they often are quite expensive and complicated, and are subject to frequent maintenance. Further, they are not adaptable to measure the number of balls to be used.

It is therefore a principal object of this invention to provide an apparatus for teeing a golf ball that is simple to construct and use, and easy to operate, A further object of this invention is to provide an apparatus for teeing a golf ball which can permit the operator to meter the balls being used with a metering ball loader divided into a plurality of ball compartments.

This and other objects will be apparent to those skilled in the art.

SUMMARY OF THE INVENTION

The golf ball dispensing and teeing device of this invention has an elongated ball dispensing arm pivotally secured to a frame. The arm has a loading end and a dispensing end. A spring connects the arm to the frame while normally holding the loading end at a lower elevation than the dispensing end. A tubular member on the frame above the loading end is adapted to hold a plurality of golf balls comprised of a lower ball with a column of balls supported on the lower ball.

The loading end of the arm has a dispensing block with a curved notch for holding the lower ball when the dispensing end is at a raised elevation, and for releasing the lower ball when the dispensing end is lower than the lower ball. The dispensing block is aligned with the arm so that when the arm is lowered the lower ball will roll down the arm from the loading end. A tee element on the frame below the dispensing end receives the lower ball when the arm is lowered.

The tubular member has an upper end with a horizontal plate thereon with an opening to pass a single golf ball therethrough. A plurality of vertically disposed ball compartments are rotatably mounted on the plate with each having an open end adapted to register with the opening in the plate to selectively dispense balls through the opening when the compartments are rotated.

DESCRIPTION OF THE PREFERRED EMBODIMENT

Figure 3:
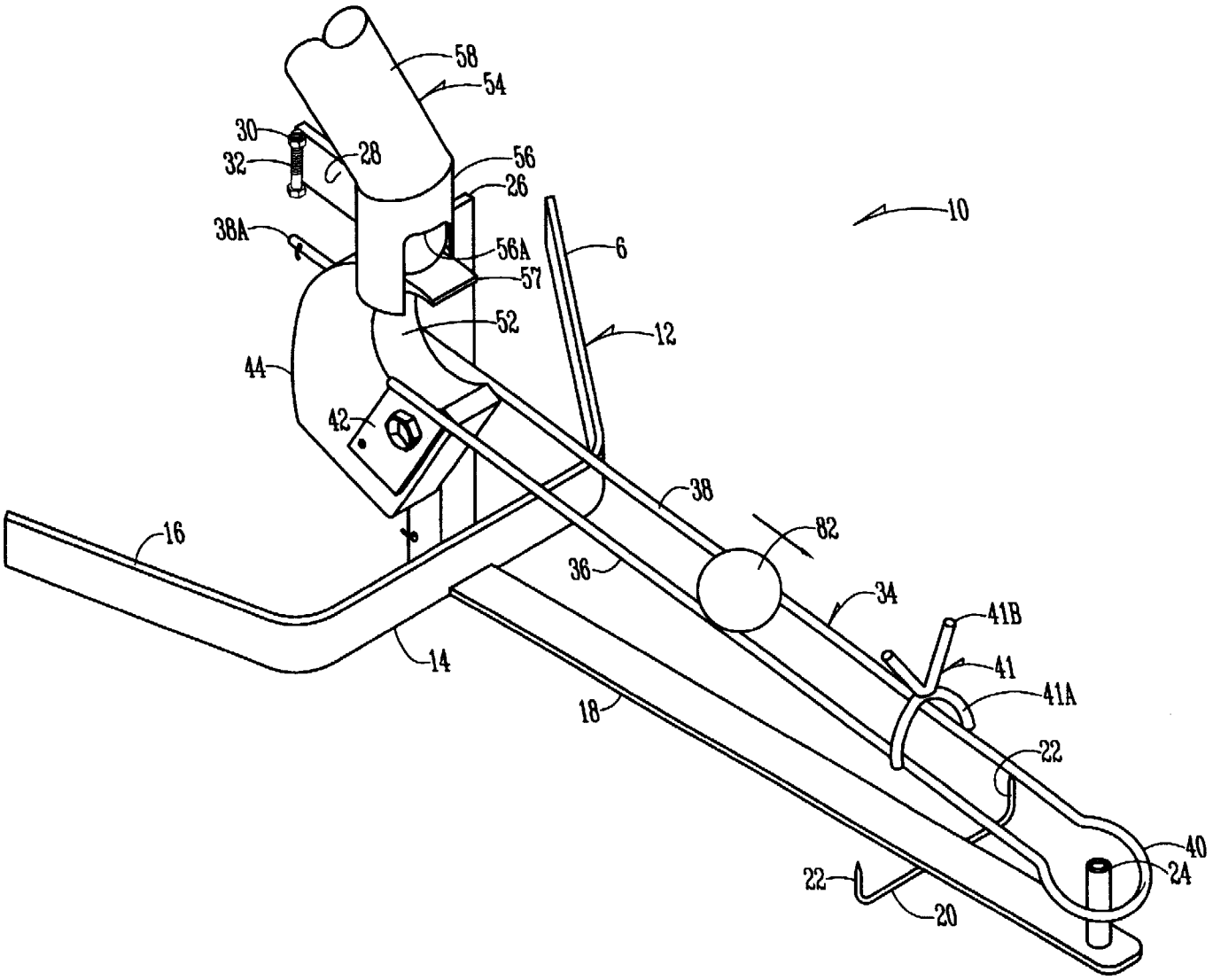
FIG. 3 is an enlarged scale perspective view of the lower portion of the device.

With reference to FIG. 3, a frame 10 is comprised of a U-shaped member 12 having a front portion and diagonal wing portions 16 at either end thereof. A flat bar 18 is welded by one of its ends to the center of front portion 14 and extends forwardly a distance of approximately 10 inches. A mat gripping bracket 20 is welded to the outer end of bar 18 and terminates in upstanding pointed barbs 22 which are adapted to penetrate a mat as will be discussed hereafter. A hollow flexible upstanding tee 24 comprised of rubber or the like is secured to the outer end of bar 18.

An upstanding angle iron 26 is welded or otherwise secured to the center of front portion 14. A rearwardly extending arm 28 is welded or otherwise secured to the upper end of member 26. A nut 30 is welded to the rearward end of arm 28 and is adapted to receive vertically disposed stop bolt 32.

An arm assembly 34 (FIG. 3) is comprised of parallel side rails 36 and 38, with rail 38 extending rearwardly farther than rail 36 and terminating in end 38A. An enlarged circular loop 40 interconnects the outer ends of rails 36 and 38. The diameter of loop 40 is sufficient to allow the conventional golf ball to pass downwardly therethrough.

A bracket 41 is welded or otherwise secured rearwardly of loop 40 and is comprised of a lower semi-circular portion 41A. A V-shaped portion 41B is welded or otherwise secured to the center of member 41A. The diameter of member 41A is sufficient to allow a conventional golf ball to roll on rails 36 and 38 thereunder as the ball rolls downwardly along the rails towards loop 40, as will be discussed hereafter.

Figure 4:
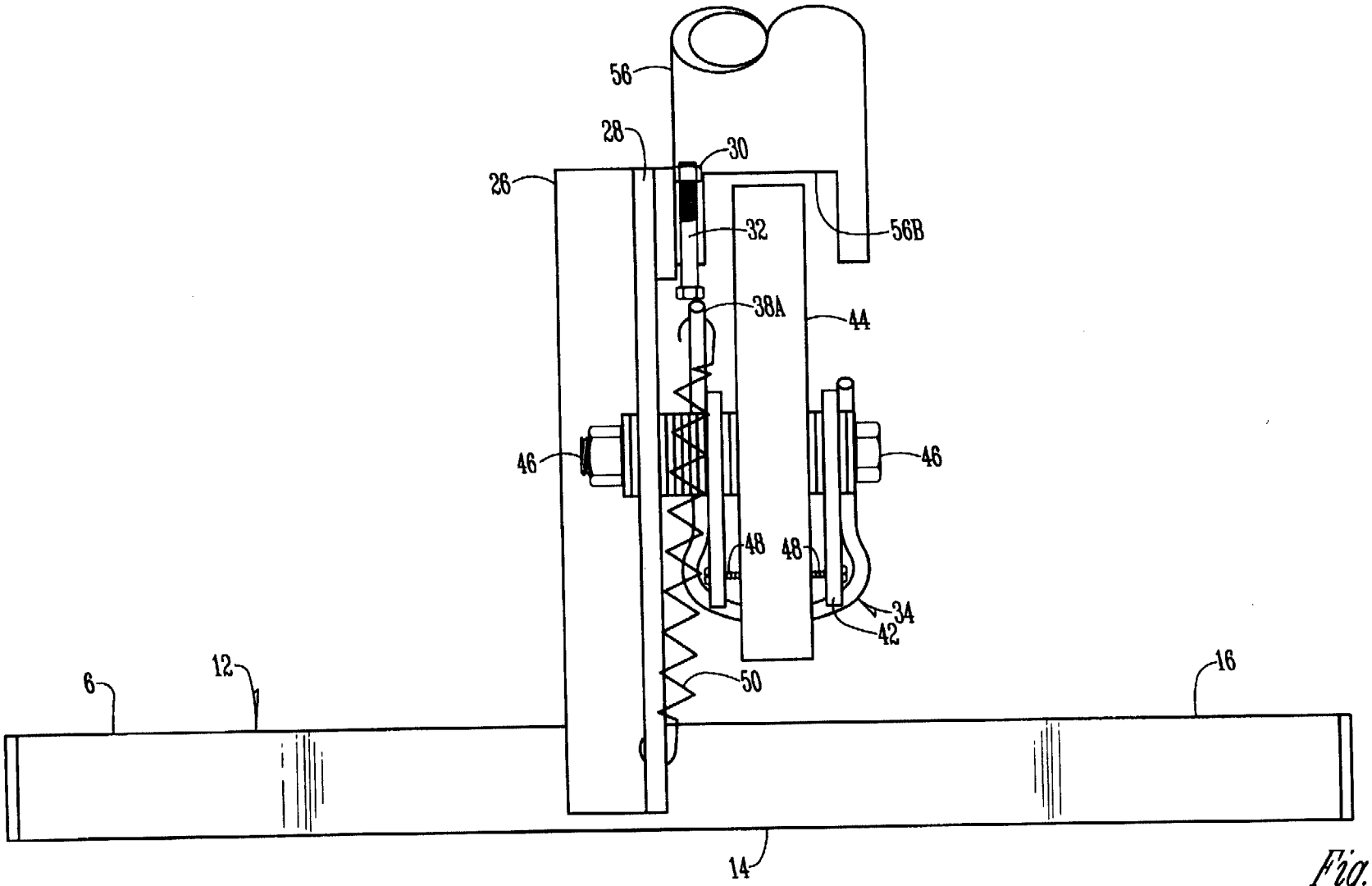
FIG. 4 is an enlarged scale front elevational view of FIG. 3.

A pair of plates 42 (FIGS. 3 and 4) are positioned on the sides of dispensing block 44 and are secured to block 44 by nut-bolt and washer assembly 46 (FIG. 4). As seen in FIG. 4, one end of the nut-bolt and washer assembly 46 extends through a suitable aperture in member 26 and is supported thereby. Screws 48 (FIG. 4) extend through suitable apertures in plates 42 to secure the plates against movement with respect to block 44. A spring 50 has one end secured to the lower portion of angle iron 26 with the upper end being secured to end 38A of rail 38. Spring 50 normally holds the arm assembly 34 in the upper position shown in FIG. 1. It should be noted that the rearward ends of rails 36 and 38 are rigidly secured to the upper surfaces of plates 42 so that the rails 36 and 38 will pivot together with block 44 about the center axis of assembly 46. Block 44 has a curved notch 52 (FIG. 2) which is adapted to receive a golf ball when the arm assembly 34 is in its upward position (dotted lines of FIG. 2), and which is adapted to dispense a ball therein for downward movement on the rails 36 and 38 (solid lines of FIG. 2) when the arm assembly is in its downward position.

A ball supply tube 54 has a lower portion 56 which is welded or otherwise secured to the upper portion of the angle iron 26. The lower portion 56 is notched in the front at 56A and is notched at the rear at 56B to permit the tongue portion 57 of block 44 to move upwardly through the notches 56A and 56B to stop the downward flow of golf balls through the ball supply tube 54 when the arm assembly 34 is in its lower position as shown in FIG. 3. This permits a single ball to be metered from the supply tube each time the arm assembly 34 is moved to the lower position of FIG. 3.

Figure 2:
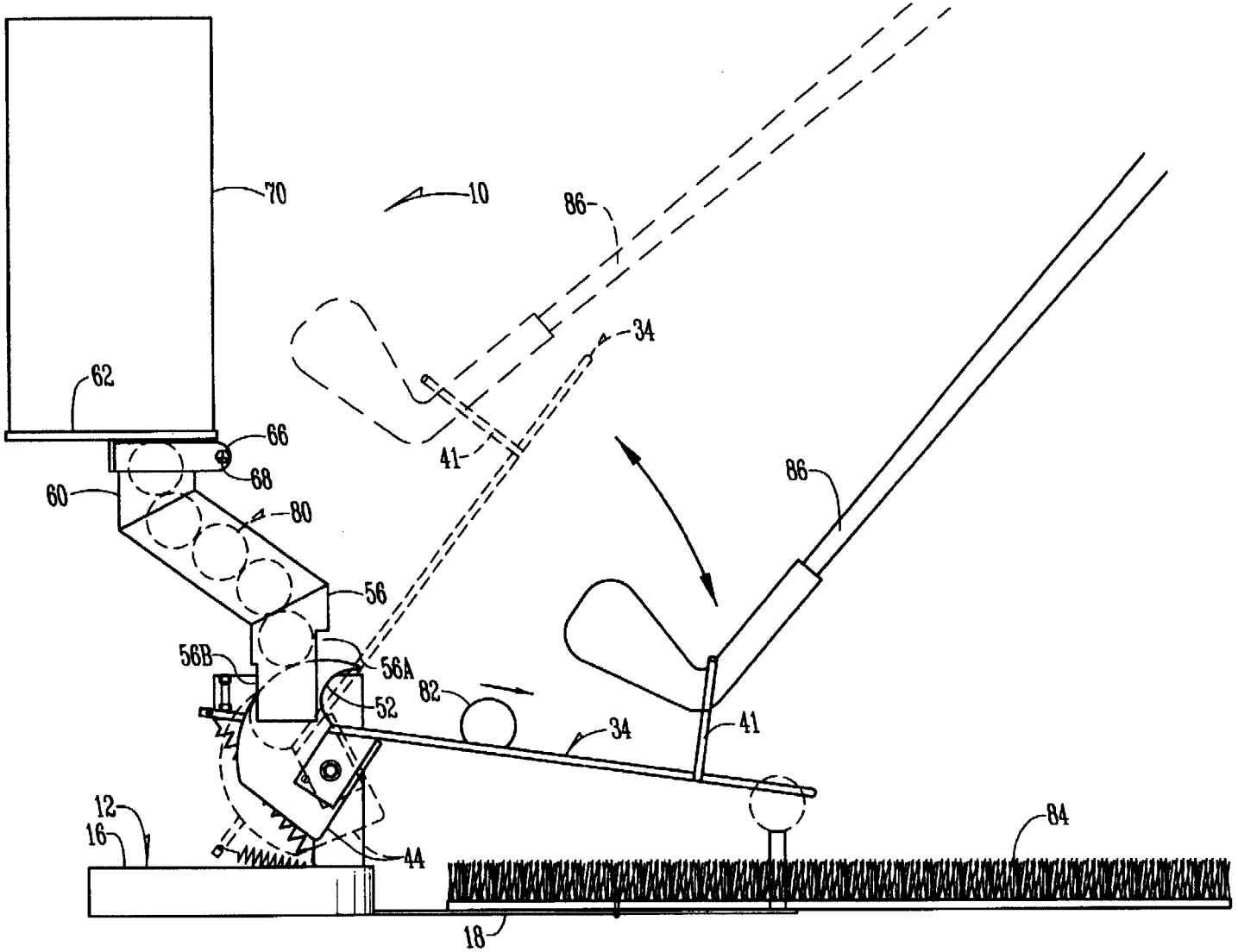
FIG. 2 is an elevational view thereof as a golf ball is being dispensed.
Figure 5:
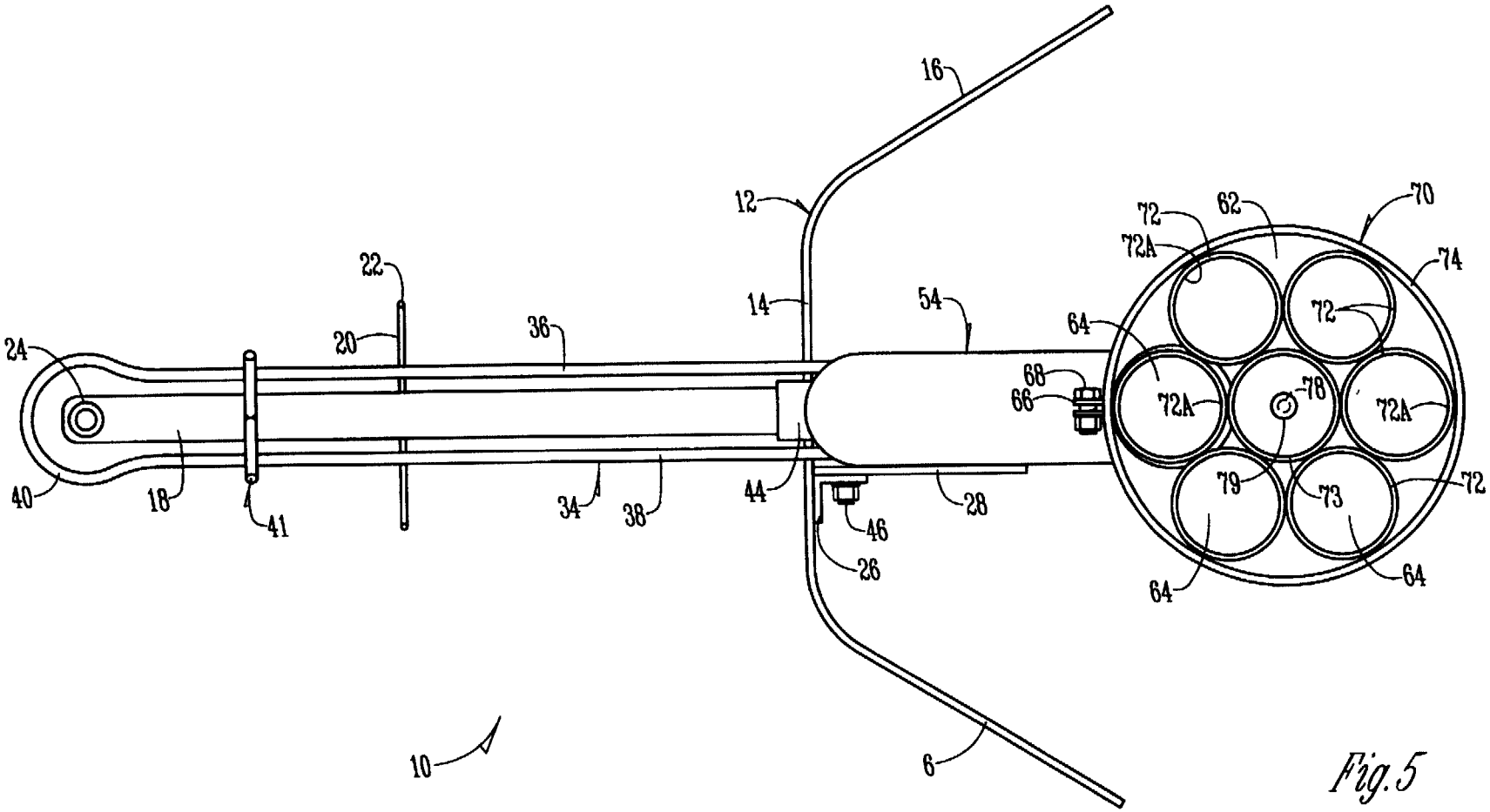
FIG. 5 is a plan view thereof.

Ball supply tube 54 has a diagonal portion 58 extending upwardly from lower portion 56. The diagonal portion 58 terminates at its upper end into the vertical upper portion 60. A plate 62 is secured in any convenient way to the upper surface of the upper portion 60 as best shown in FIG. 2. Plate 62 has an opening 64 (FIG. 5) therein which is adapted to permit a single golf ball to pass vertically therethrough. Plate 62 is secured to the upper portion 60 by any convenient means such as by bracket 66 which is held in place by bolt assembly 68.

Figure 6:
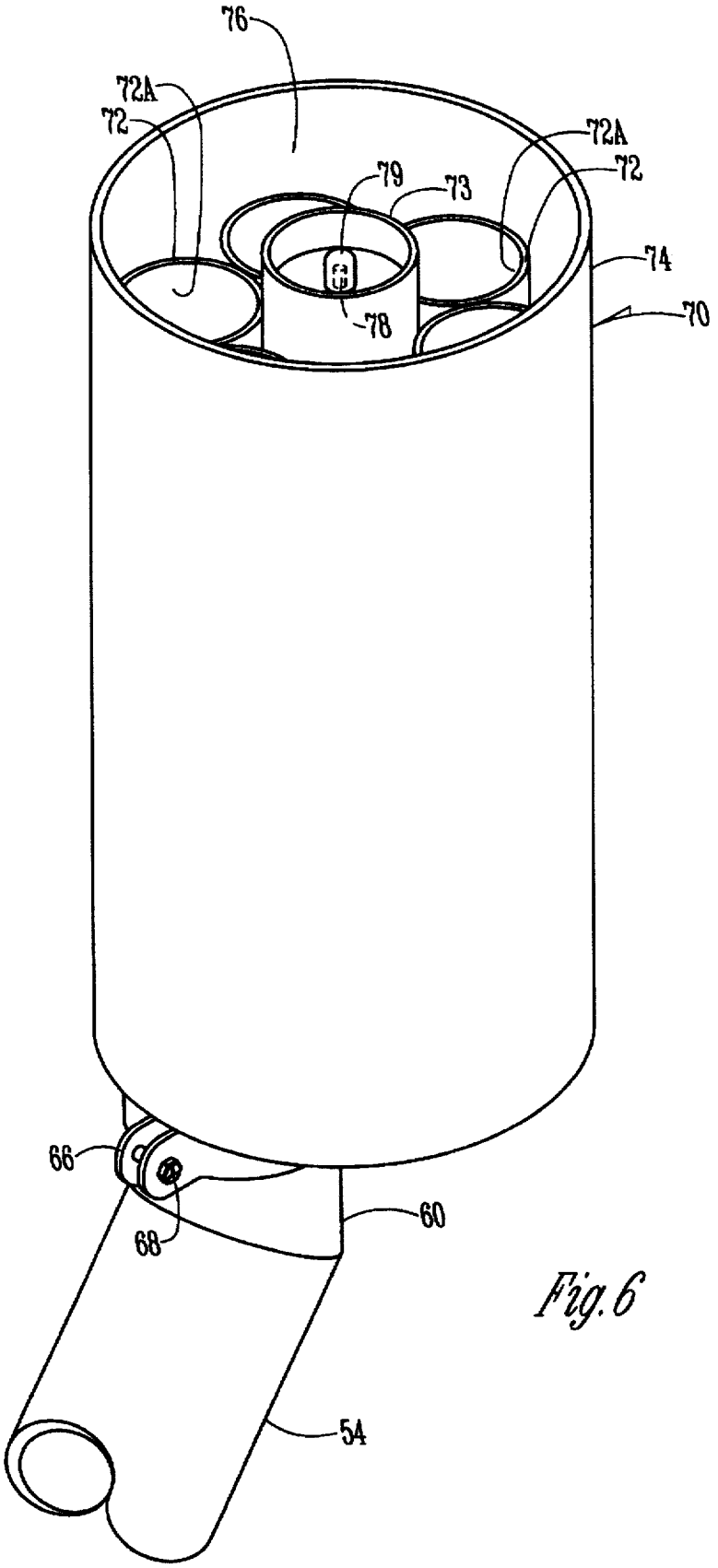
FIG. 6 is a large scale perspective view of the upper portion of the device.

A ball reservoir 70 (FIGS. 5 and 6) is detachably mounted on plate 62. Reservoir 70 is comprised of a plurality of outer tubes 72 which are secured in any convenient way to a central tube 73. Tubes 72 have open upper and lower ends and the interiors thereof comprise separate vertically disposed ball compartments 72A. An outer sleeve 74 slidably embraces the assembled tubes 72. Sleeve 74 terminates in an upper portion 76 which extends several inches above the tubes 72. A center post 78 extends downwardly through center tube 73 and extends upwardly therefrom to permit the operator to manually rotate the assembled tubes 72. A suitable cap 79 can be placed upon the upper end of post 78 for the convenience of the operator. It should be noted that the open lower ends of tubes 72 are adapted to be selectively registered with opening 64 in plate 62 as the assembled tubes are rotated within sleeve 74 on the plate 62. The lower end of the sleeve detachably but frictionally engages the outer surface of plate 62.

Figure 1:
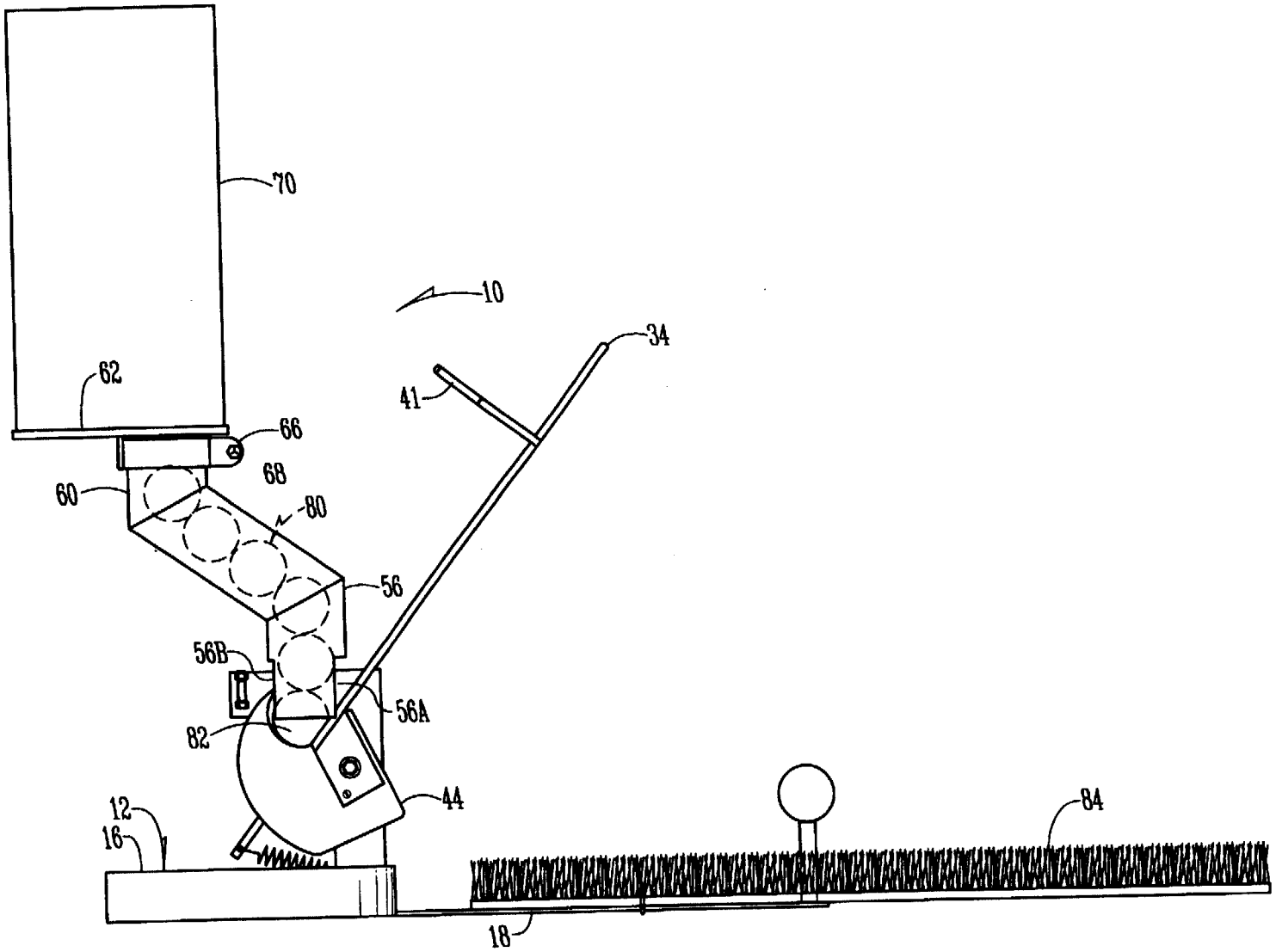
FIG. 1 is a side elevational view of the device of this invention in its static mode.

As seen in FIG. 1, a column of balls 80 rests on a lower ball 82 when the device is in its static position of FIG. 1.

In operation, the foregoing device is mounted on a flat supporting surface, and a tufted mat 84 is placed over the flat bar 18, the bracket 20 and the tee 24. A suitable aperture to permit penetration of the tee is provided in the mat 84. The upstanding pointed barbs 22 penetrate the lower portion of mat 84 to stabilize the device and the mat together.

The operator provides a plurality of balls into the ball reservoir 70. Since the upper portion 76 of sleeve 74 extends above the upper ends of tube 72, it is easy to pour balls into the upper end of sleeve 74 from a bucket or the like without spilling the balls to the ground. The balls migrate into a plurality of columns of balls within the ball compartment 72A. Typically, each tube 72 is adapted to receive six vertically disposed golf balls. The assembled tubes 72 should be rotated in the manner described above so that at least one of the tubes 72 registers with the opening 64 in plate 62. The balls in the tube will pass down into the ball supply tube 54 which normally will contain at least six golf balls including the lower ball 82. The device in the drawings has a capacity to hold 36 balls in the assembled tubes 72 plus six additional balls in the tube 54. When the golfer has supplied the device with a plurality of golf balls as described above, the operator will use the golf club 86 (FIG. 2) to depress the arm assembly 34 by exerting the golf club downwardly against the bracket 41. This causes the dispenser block 44 to rotate downwardly along with rails 36 and 38 so that the curved notch 52 assumes the attitude shown in FIG. 2. This permits the lower ball 82 to roll downwardly out of the curved notch 52 on rails 36 and 38. The operator will keep the arm assembly 34 in the lowered or depressed state of FIG. 2 until the ball 82 has rolled downwardly to the outer ends of rails 36 and 38, thence through the enlarged circular loop 40 for deposit on the upper end of tee 24. The tongue 57 supports the column of balls 80 during this time (FIG. 3).

The golf club 86 is thereupon released from the bracket 41, whereupon the spring 50 will cause the arm assembly and the block 42 to rotate from the position shown in FIG. 2 back to the dotted lines shown in that Figure, namely, the position shown in FIG. 1. Stop bolt 32 can be adjusted in nut 30 to adjust the motion of arm assembly 34.

The operator will then proceed to hit the ball from the tee, and the process as described above is repeated. This continues until all of the balls in the tube 54 and the tube 72 aligned thereabove have been utilized. The operator can then reach down and by grasping the cap 79, the assembled tubes 72 are rotated on plate 62 until an adjacent tube 72 filled with balls is in alignment with the opening 64 in the plate. This provides an additional column of balls 80 within the tube 54 (FIG. 1) all mounted on top of another lower ball 82. That process is continued until the supply of balls present in the remaining tube 72 are exhausted. By knowing how many balls each of the tubes contain, the operator will always know how many balls have been hit and can easily tell how many balls remain to be hit.

From the foregoing, it is seen that this invention will achieve at least all of its stated objectives.

What is claimed is:

1. A golf ball dispensing and teeing device, comprising, a frame, an elongated ball dispensing arm pivotally secured to said frame, and having a loading end and a dispensing end, a spring connecting said arm and said frame for normally holding said loading end at a lower elevation than said dispensing end, a first tubular member on said frame above said loading end is adapted to hold a plurality of golf balls comprised of a lower ball with a column of balls supported on said lower ball, said loading end of said arm having a dispensing block for holding said lower ball when said dispensing end is at a raised elevation with respect to the lower ball, and for releasing said lower ball when the dispensing end is lower than said lower ball, said dispensing block being aligned with said arm so that when said arm is lowered, said lower ball will roll down said arm from said loading end to said dispensing end, a tee element on said frame below said dispensing end for receiving said lower ball when said arm is lowered, a horizontal plate positioned above and adjacent an upper end of said first tubular member, an opening in said plate registering with the upper end of said first tubular member, a ball reservoir comprising an outer sleeve which surrounds a plurality of second tubular members which have a height substantially equal to the height of said outer sleeve and are adapted to hold a plurality of vertically stacked golf balls therein.

said ball reservoir being rotatably mounted on said plate and having open upper and lower ends with the lower ends thereof adapted to be selectively registered with the opening in said plate upon selective rotation of said second tubular member on said plate so that balls in said second tubular members can pass through said opening into the upper end of said first tubular member.

2. The device of claim 1 wherein a flat mat element extends over said frame adjacent said tee, with said tee extending upwardly through said mat.

3. The device of claim 1 wherein said frame has connector elements thereon for connecting said mat to said frame.

4. The device of claim 1 wherein a tapered tongue element extends partially over said curved notch to support said column of balls while said lower ball is released from said curved notch.

5. The device of claim 1 wherein adjustment means are on said frame in the pivotal path of said dispensing arm to adjust the pivotal motion of said dispensing arm.

6. The device of claim 1 wherein said ball reservoir is further comprised of a central tube centrally located with respect to said second tubular members.

7. The device of claim 7 wherein said central tube extends above the level of the upper ends of said second tubular members.

8. The device of claim 1 wherein said second tubular members are vertically positioned on said plate.

9. The device of claim 7 wherein said sleeve is detachably fixed to said plate, and said second tubes and said central tube are rotatable within said sleeve.

* * * * *